US005740905A

United States Patent [19]

Kilfoy

[11] Patent Number: 5,740,905

[45] Date of Patent: Apr. 21, 1998

[54] KEY RING ATTACHABLE LIGHTER HOLDING SHELL WITH FLEXIBLE HOLDING FLAPS

[76] Inventor: Kevin Lee Kilfoy, 122 E. 17th St., Davenport, Iowa 52803

[21] Appl. No.: 659,507

[22] Filed: Jun. 6, 1996

[51] Int. Cl.[6] ..... A24F 19/00

[52] U.S. Cl. ..... 206/87; 206/37; 206/38; 215/224

[58] Field of Search ..... 206/38, 37, 37.1, 206/37.4, 86, 87, 38.1; 70/456 R; 215/224, 317; 220/780; D27/161; D3/208, 226

[56] References Cited

U.S. PATENT DOCUMENTS

| | | | |
|---|---|---|---|
| D. 114,210 | 4/1939 | Florman | 206/38 |
| D. 267,590 | 1/1983 | Varma | D27/161 |
| D. 298,771 | 11/1988 | Thomas | D3/226 |
| D. 298,781 | 12/1988 | Thomas | D3/208 |
| 2,982,454 | 5/1961 | Wolberg | 206/38.1 X |
| 3,434,614 | 3/1969 | Moller | 215/224 |
| 3,853,237 | 12/1974 | Marchant | 215/224 |
| 4,082,496 | 4/1978 | Johnson | D27/161 X |
| 4,765,459 | 8/1988 | Edwards | 206/38.1 |
| 5,363,680 | 11/1994 | Wu | 70/456 R |

FOREIGN PATENT DOCUMENTS

| | | | |
|---|---|---|---|
| 1432121 | 12/1966 | France | 206/87 |
| 132089 | 6/1929 | Germany | 70/456 R |

*Primary Examiner*—Bryon P. Gehman
*Attorney, Agent, or Firm*—Robert O. Richardson

[57] ABSTRACT

The key ring attachable lighter holding shell with flexible holding flaps is a shell-shaped holder into which a reusable lighter or a disposable lighter may be inserted and held securely, yet can also be taken out and replaced again, and it may be attached to a key ring or key chain in order to help prevent a person from losing a lighter as long as the keys are not lost.

2 Claims, 4 Drawing Sheets

KEY RING ATTACHABLE LIGHTER HOLDING SHELL WITH FLEXIBLE HOLDING FLAPS

BACKGROUND OF THE INVENTION

1. Technical Field

This invention may be classified as a holding shell with flexible holding flaps, for a gas or fluid reusable lighter or disposable type lighter that may be attached to a key ring or key chain.

2. Description of Related Art

Methods for the convenient storage of articles such as butane lighters on a person during periods of non-use, as well as use, have been explored in the prior art. These generally consist of a device for holding the article which has a length of cord attached to it. The opposite end of the cord is attached to a spring loaded reel contained in a false bottom of a box-like housing. Some of the embodiments shown include clips for attachment to wearing apparel such as a belt. An example of such a device is shown and described in U.S. Pat. No. 4,486,169, entitled "Cigarette Lighter Securing Accessory", such patent issuing to Lewis on Dec. 4, 1984. The drawback with this method is that the mobility of the user of the article is limited to the length of the attachment cord, and it is also not easily concealable.

A decorative holder for articles that is shown in FIG. 5 of U.S. Pat. No. 4,576,839, entitled "Decorative Holder" such patent issuing to Parren on Nov. 19, 1984 is described as including a body which is in form of generally elongate sleeve defining an axially extending opening which is generally oval in configuration. As such, this sleeve is in no way enclosed at either end. The present invention differs in that the body of the present invention consists of an elongated circular, square, or oval shaped shell complete with a fully enclosed bottom end with a section fixed to it that has a hole through it, to which a key ring or key chain can be attached.

The slide means in the elongated slots on both sides of the decorative holder for articles described in U.S. Pat. No. 4,576,839 is "adaptable to removably receive a key". The slide means is further described in the specification as "a U-shaped carrier . . . that can be removed for attachment or removal of keys". As such it is serving directly as a "key ring" in effect, to which keys may be directly attached. Unlike this prior art, the present invention is not intended and is not able to receive or hold keys directly and thereby serve as a "key ring" itself, but is designed instead to be attachable to any existing key ring or key chain, in the same way a key is, by means of a hole through the permanent, non-removable key ring attachment piece fixed to the shell. Therefore it is more universally adaptable because it can be attached onto any type of key ring, just like adding another key.

Most significantly, the decorative holder for articles that is shown in FIG. 5 of U.S. Pat. No. 4,576,839 also is not intended to hold any additional articles other than keys as confirmed by the statement in the specifications that "when the user wishes to utilize the keys, the keys can be appropriately advanced from the lower retracted position to the extended position by the slide or carrier".

It is further noted that with the U-shaped slide or carrier and the attached keys in either the lower retracted or the extended position, it is not practically possible to insert a lighter into the sleeve to be held simultaneously. For this reason and because of the absence of mention of any intention for any other article, including a lighter to be held in the sleeve simultaneously with one or more keys attached, it is obvious to contend that this embodiment was only intended to hold one or more keys as stated and no other articles, including lighters, in the sleeve.

SUMMARY OF THE INVENTION

It is an object of the present invention to provide for the convenience of having a lighter available anytime a person is in possession of their key ring or key chain. Another object is to reduce any possibility of the loss of one's lighter as long as one's key ring or key chain is not lost. Because of the important nature people generally associate with their keys, most people seldom permanently lose them or likewise any items that may be attached to them. Therefore it is contended that this is not simply a novel combination of features, but is a combination of features that provides for a "personal convenience" by way of securing a lighter accessibly on one's person, while it also performs the desirable function of "loss prevention" of such an item, which could perhaps also result in money saved that may otherwise be spent on replacement of lighters.

The present invention provides a key ring attachable lighter holding shell with flexible holding flaps that press against a lighter and secure it in the holding shell. It consists of a two-piece, holding shell with an open top end and an enclosed bottom end into which a gas or fluid type reusable lighter or a gas or fluid type disposable lighter may be inserted, and then attached to a key ring or key chain. The shell body may be in the general shape of any type of lighter it is intended to hold including, but not limited to, elongated square, rectangular, circular or oval shaped. There is a separate cap, with an opening in the top of it, to insert the lighter through that is snapped onto the top, open end, of the shell body. This is done by a raised ringed ridge on the outside circumference of the top of the shell body that seats into a corresponding ringed groove in the inside circumference of the open ended cap when the two parts are snapped together. There are eight "notched flaps" of plastic around the inside circumference of the top of the open ended cap. When the lighter is inserted into the holding shell, the flaps on the open ended cap are flexed (bent inward) and press against the lighter and hold it in place. There is a section that is a part of the bottom of the shell body of the holding shell with a hole through it that permits the holding shell to be attached to a key ring or key chain. This key ring attachment section may also alternatively be a part of the wall of the shell body or wall of the open ended cap.

DETAILED DESCRIPTION OF THE PREFERRED EMBODIMENT

Figure 1:
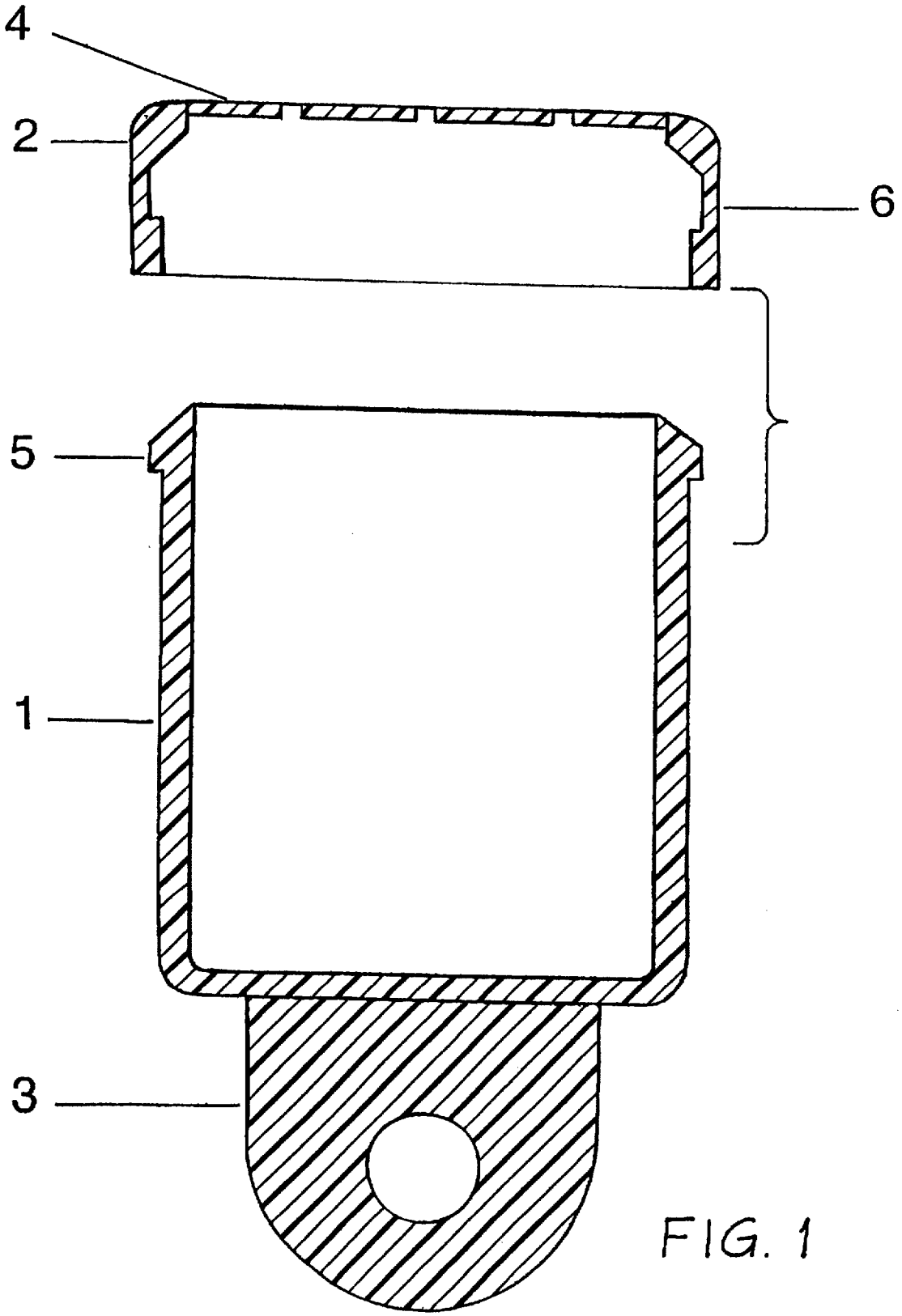
FIG. 1 is a Front Cross Section View of one embodiment of the present invention that shows a generally elongated oval, shell-shaped, open ended body of the lighter holder and the separate oval shaped cap, embraced by a bracket to show how the two parts are assembled together.
Figure 2:
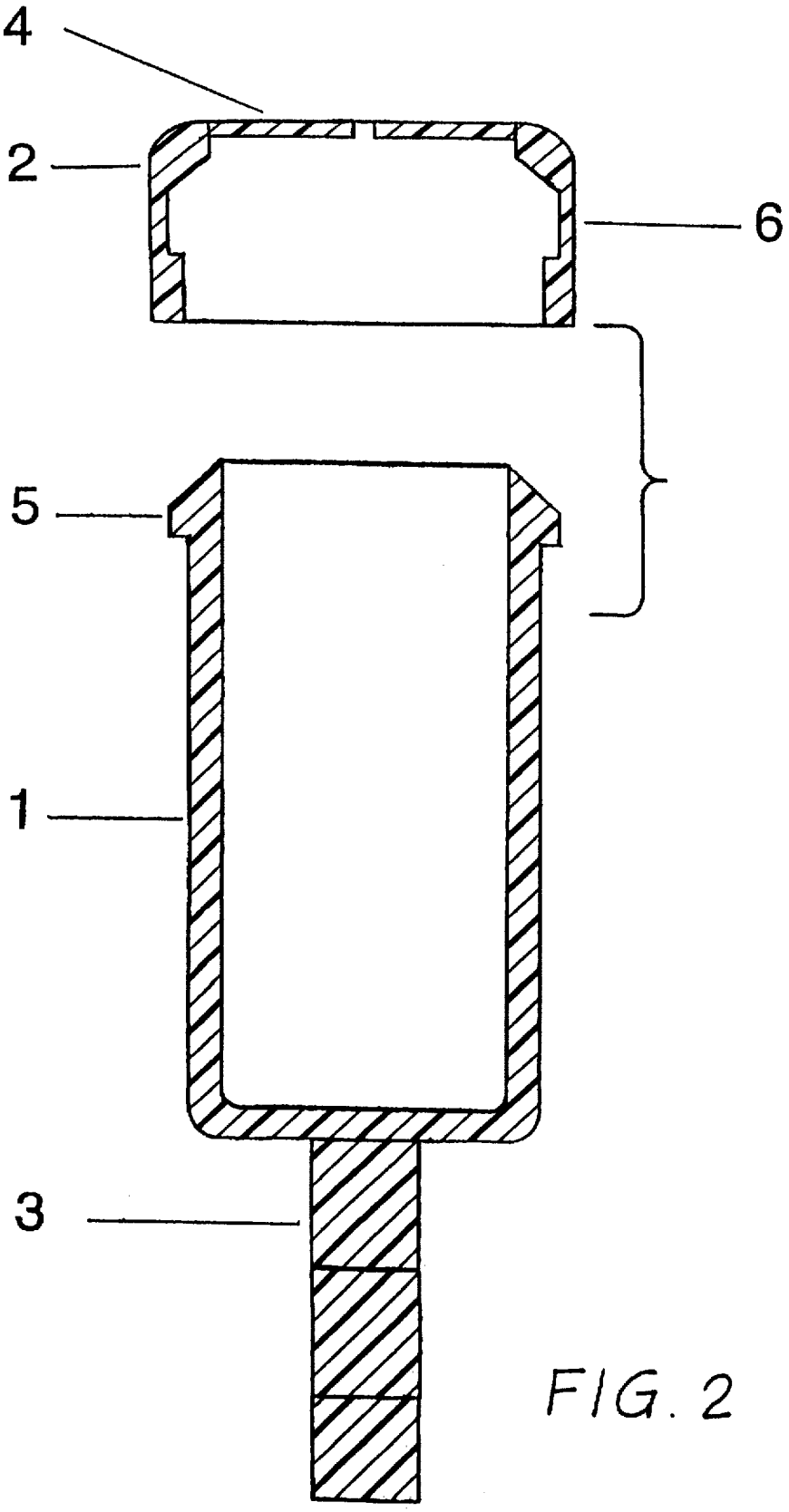
FIG. 2 is a Side Cross Section View of one embodiment of the present invention that shows a generally elongated oval shell-shaped body of the holder and the separate oval shaped, open ended cap, embraced by a bracket to show how the two parts are assembled together.
Figure 3:
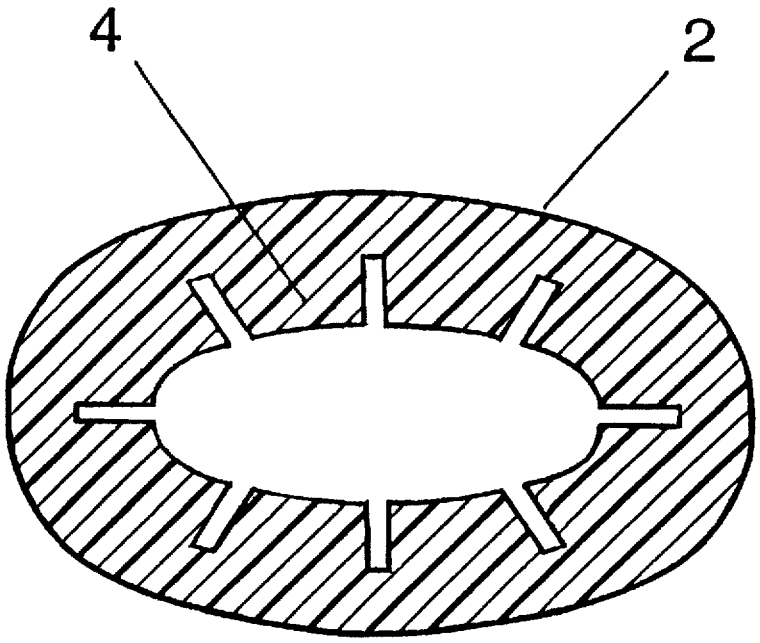
FIG. 3 is a Top Surface View of one embodiment of the present invention that shows an oval shaped, open ended cap that is assembled to a generally elongated oval shell (not shown). Eight notched flaps are shown surrounding the inside circumference of the top of the open ended cap. When a lighter is inserted through the opening in the middle of the cap and into the shell shaped body, the eight notched flaps press inward against the lighter and hold it in place.
Figure 4:
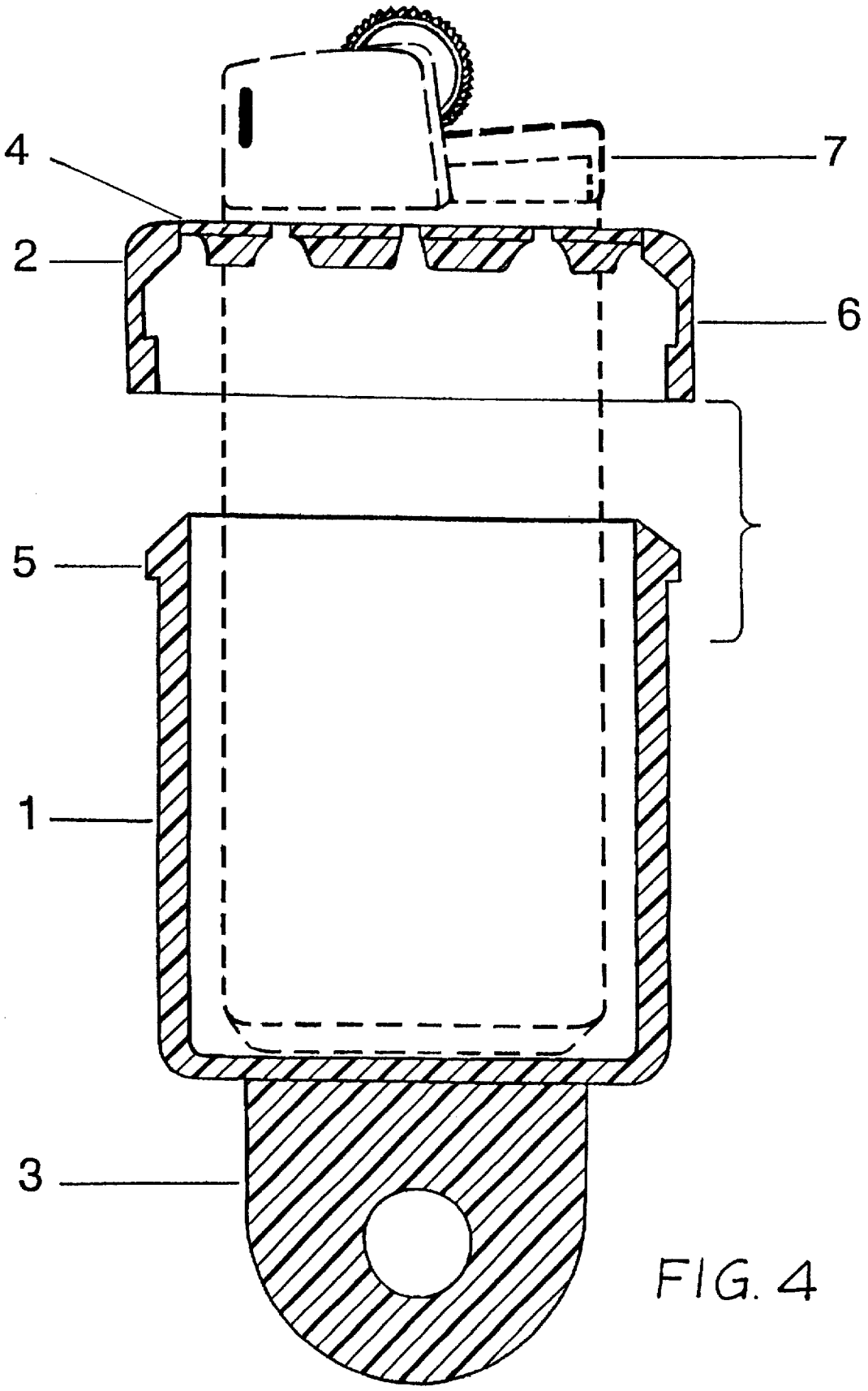
FIG. 4 is a Front Cross Section View of one embodiment of the present invention that shows a generally elongated oval shell-shaped body of the holder and the separate oval shaped open ended cap, embraced by a bracket to show how the two parts are assembled together. A butane lighter is shown as it would be inserted into the holding shell and is indicated by phantom lines.

The key ring attachable lighter holding shell with flexible holding flaps is a generally elongated square, rectangular, circular, or oval-shaped plastic shell body 1 that is snapped together with a second piece, which is a plastic cap 2 that snaps down onto the top, open end, of the shell body and has an opening in the middle of it into which a reusable lighter or disposable lighter 7 (shown in phantom lines) is inserted through and into the shell body. Fixed to the outside wall of the bottom end of the holding shell there is a section of material with a hole through it 3 (preferably molded in one piece with the shell body) that enables the lighter holder holding shell to be attached to any key ring or key chain. This key ring attachment section may also alternatively be a part of the outside wall of the open ended cap.

There are eight "notched flaps" of plastic 4 around the inside circumference of the top of the open ended cap. The opening in the middle of the top of the cap, between all of the notched flaps, is in the shape of the circumference of a lighter, but is slightly smaller. When the lighter is inserted open ended cap and into the shell body, the flaps on the cap are flexed (bent inward) and press against the lighter and hold it in place. The eight plastic notched flaps only slightly touch against the lighter so that it can be easily taken out and reinserted or replaced with a new lighter when necessary. There is otherwise nothing holding a lighter in the shell body of the holding shell because there is a gap of space between the outside circumference of the lighter and the inside circumference of the shell body.

The shell body has a raised ringed ridge 5 around the outside circumference of the top open end of it. There is a corresponding ringed groove 6 around the inside circumference of the cap and the raised ringed ridge on the open end of the shell body seats into it when the open ended cap is pressed onto the shell body. The cap can be taken off by hand with a slight pull and snapped back onto the shell body again.

The ringed ridge on the shell body is located at the actual top edge, so that the inside edge of the top of the ridge is also the inside edge of the top of the shell body when looking at it from a side cross-section view. From this same view point, the contour of the ridge slopes downward and outward from the top inside edge of the shell body at about a 45° angle, out past the outside surface of the shell body until it reaches about ½ of the width of the ridge (as measured from the top edge of the ridge to the bottom edge of the ridge). At this point it angles straight down parallel to the shell body for the remaining ½ of the width of the ridge and then turns back at a 90° angle at the bottom of the ridge until it meets the surface of the shell body.

The groove in the open ended cap into which the ridge on the shell body is seated is conversely designed to receive and fit the ridge. This type of contour design of the ridge on the shell body and the groove in the cap of the lighter holding shell enable the open ended cap to more easily fit onto the top of the shell body because the downward 45° angle of the ridge helps to guide the shell to fit into the open ended cap.

In addition, the 90° perpendicular angle of the bottom edge of the ridge requires a definite intent and effort in order to remove the open ended cap from the shell body of the lighter holding shell.

The type of 45° angled hatching shown in all drawings indicates that the material utilized in the embodiment shown is plastic.

The key ring attachable lighter holding shell with flexible holding flaps is intended to secure a lighter to a key ring or key chain in order to provide for convenient accessibility. It also is intended to assist in loss prevention of a lighter as long as a person does not lose their keys. As a result it may also provide for a noticeable savings of money that may otherwise have been spent on replacement lighters over a period of time.

The preferred embodiment of the key ring attachable lighter holding shell is made by utilizing a prefabricated mold for both the shell body of the holder and the open ended cap with a plastic injection molding machine and then simply snapping the open ended cap onto the shell body once the two pieces have been molded. A key ring or key chain may then be attached to the hole provided. Other methods and materials may be utilized to provide a similar design.

Other methods, materials, modifications, or variations to the invention described herein may be contemplated. However, to the extent that these methods, modifications, or variations do not depart from the spirit and scope of the claims included here, it is my intention that they be encompassed therein.

What is claimed as being new and desired to be protected by Letters Patent of the United States is as follows:

1. A key holder-attachable open-ended shell for holding lighters comprising in combination:

a generally elongated hollow shell body having an open top at a first end of said shell body and a lighter cavity shaped to receive a lighter, said lighter cavity being bounded by side wall portions and by a closed bottom at a second end of said shell body, and a section that is a part of said shell body with a hole through it that permits said shell to be attached to a key holder, an open-ended cap adapted to receive and fit into the top of said hollow shell body, said open-ended cap having individual flexible plastic flap means for pressing against the side walls of a lighter to secure said lighter in said holding shell, said flexible plastic flap means surrounding the circumference of the top of said open-ended cap and extending inwardly toward the center of said open-ended cap with linear gaps between said flexible plastic flap means extending slightly inwardly from where said flap means are attached to the inside circumference of said side walls of said open-ended cap to form the outside circumference of an opening in the center of the top of said open-ended cap, in the shape of the circumference of the lighter to be held thereby, but slightly smaller than the circumference of the lighter to be held thereby, said opening being generally adapted to receive said lighter.

2. The shell of claim 1 wherein said hollow shell body has a raised ringed ridge protruding around the outside circumference of said open top at the first end of said holder, wherein said ringed ridge receives and fits a conversely corresponding ringed groove set into the inside diameter of said open-ended cap when said open-ended cap is pressed onto said open top at the first end of said hollow shell body being the same inside top edge of said ringed ridge and the contour of the ridge slopes downward and outwardly from the inside top edge of said hollow shell body at a 45 degree angle, said ridge sloping out past the outside surface of the side wall of said hollow shell body until it reaches one-half of the width of said ringed ridge as it is measured from the top edge of the ridge to the bottom edge of the ridge wherein it angles straight down parallel to said hollow shell body for the remaining one-half of the width of said ringed ridge and then angles back inwardly 90 degrees at the bottom edge of said ringed ridge until it meets the outside surface of said hollow body.

* * * * *